US005565898A

United States Patent [19]

Sakuma

[11] Patent Number: 5,565,898

[45] Date of Patent: Oct. 15, 1996

[54] INK EJECTING PRINTER HAVING DIFFERENT CLEANING TIMINGS

[75] Inventor: Mikio Sakuma, Ichinomiya, Japan

[73] Assignee: Brother Kogyo Kabushiki Kaisha, Nagoya, Japan

[21] Appl. No.: 316,324

[22] Filed: Sep. 30, 1994

[30] Foreign Application Priority Data

Nov. 5, 1993 [JP] Japan ..... 5-276453
Nov. 5, 1993 [JP] Japan ..... 5-276454

[51] Int. Cl.[6] ..... B41J 2/165

[52] U.S. Cl. ..... 347/23; 347/30; 347/33

[58] Field of Search ..... 347/12, 13, 9, 347/15, 41, 43, 22, 23, 24, 30, 31, 32, 33, 35

[56] References Cited

U.S. PATENT DOCUMENTS 5,126,765 6/1992 Nakamura ..... 347/33
5,202,702 4/1993 Terasawa et al. ..... 347/30
5,406,317 4/1995 Shimamura et al. ..... 347/23

FOREIGN PATENT DOCUMENTS 0531535 3/1993 European Pat. Off. .
2-141248 5/1990 Japan .
3-5154 1/1991 Japan .
4-80041 3/1992 Japan .

*Primary Examiner*—John E. Barlow, Jr.
*Attorney, Agent, or Firm*—Oliff & Berridge

[57] ABSTRACT

An ink ejecting printer capable of increasing a printing speed by eliminating unnecessary head maintenance operations includes a mode controller, a ROM, timing value storage, a wiping ordering unit and a suction ordering unit. When a normal print mode is selected, the mode controller supplies the timing value storage with the initial values of the wiping and suction timings held in the ROM; when a thin-out mode is selected, the mode controller supplies the storage with changed values. The timing value storage stores the wiping and suction timings sent from the mode controller. When a print operation is started, the wiping ordering unit and suction ordering unit retrieve the values of the wiping and suction timings from the timing value storage. When the print operation is found to have reached one of the timings, the corresponding unit suspends the printing and causes the appropriate wiping or sucking operation to be carried out. This makes it possible, when the thin-out mode is selected, to reduce unnecessary head maintenance operations and thereby increase the printing speed.

20 Claims, 3 Drawing Sheets

INK EJECTING PRINTER HAVING DIFFERENT CLEANING TIMINGS

BACKGROUND OF THE INVENTION

1. Field of the Invention

The invention relates to an ink ejecting printer having maintenance means for maintaining an ink ejecting head used in the printer.

2. Description of the Related Art

There exist ink ejecting printers having maintenance means for maintaining the ink ejecting head. A typical example of the maintenance means is a wiping member that slides over the nozzle surface of the head to wipe paper powder, dust or ink of increased viscosity therefrom. Another typical maintenance means constitutes suction means for sucking excess ink from the nozzle surface of the head, or forced discharging means for forcibly discharging ink from inside the head, whereby the impurities and air bubbles within the head are discharged therefrom along with a small amount of ink. Many of the recently introduced ink ejecting printers combine these two maintenance means, i.e., the wiping means and the suction or forced discharging means.

With the above ink ejecting printers, a head maintenance operation is carried out at intervals based upon predetermined parameters (for example, operation time, number of characters printed, number of dots printed, and/or number of pages printed). Illustratively, some conventional ink ejecting printers switch their timing for wiping from a predetermined period of operation performed to the predetermined number of dots to be printed, as disclosed in Japanese Unexamined Patent Publications Nos. 2-141248 and 3-5154.

Because the printers are expected always to provide printing of high quality, certain reductions in printing speed are bound to occur regardless of the timing of head maintenance. Illustratively, there are two major modes in which ink ejecting printers are used: one in which the printer prints on a draft, or lower quality, basis the documents prepared typically by a host computer, and the other in which the printer makes a high quality print of what was printed on the draft basis, edited accordingly, and finalized. For draft printing, what many of today's users typically want is primarily rapid printing at the expense of somewhat reduced levels of printing quality. The requirement for rapid printing is met by ink ejecting printers that permit selection of either normal print mode where desired image patterns are printed unmodified, or thin-out mode where the image patterns are thinned out before being printed. With the quality of printing reduced, the thin-out mode nevertheless offers the advantage of lower ink consumption and a boost in printing speed.

The above ink ejecting printers with two modes, when equipped with the head maintenance function, have one disadvantage. That is, the timing of head maintenance using the head maintenance function in thin-out mode is the same as in the normal print mode. Users having selected thin-out mode for trial printing are often disappointed to see the speed of printing not increased as significantly as they hoped would be the case.

Further, some conventional ink ejecting printers have a water repellent layer formed over the nozzle surface to prevent the retention of excess ink thereon in order to enhance the linearity of ejected ink drops. In particular, many recently developed ink ejecting printers combine the wiping means with the water repellent layer to achieve higher levels of printing quality. In such printers, however, those that perform wiping both in the draft print mode and in the normal print mode tend to suffer from a shorter service life of their print head. This is because every time the nozzle surface is wiped, a bit of the water repellent layer is peeled therefrom.

SUMMARY OF THE INVENTION

An object of the invention is to overcome the above and other deficiencies and disadvantages of the prior art printers and to provide an ink ejecting printer capable of enhancing the printing speed by eliminating unnecessary head maintenance operations.

Another object of the invention is to provide an ink ejecting printer capable of maintaining an ink ejecting head at a timing that the users desire.

In order to achieve the above objects, an ink ejecting printer according to one embodiment of the invention comprises: maintenance means for maintaining an ink ejecting head; operation means for operating the maintenance means at a predetermined operation timing; selection means for selecting one of two modes, one of the two modes being a normal print mode in which desired image patterns are printed unmodified and the other of the two modes being a thin-out mode in which the image patterns are thinned out before being printed; and timing changing means, when the normal print mode is selected, for setting the operation timing of the operation means to a first value and, when the thin-out mode is selected, for setting the operation timing of the operation means to a second value which is greater than the first value.

With the ink ejecting printer of the structure outlined above, the timing changing means sets the operation timing of the operation means to the first value when the normal print mode is selected and when the thin-out mode is selected, the timing changing means sets the operation timing to the second value which is greater than the first value. The operation means then operates the maintenance means in accordance with the operation timing so changed.

In order to achieve the above objects, an ink ejecting printer according to another embodiment of the invention comprises: maintenance means for maintaining an ink ejecting head; operation means for operating said maintenance means at a predetermined timing; and timing changing means for changing the timing.

With the ink ejecting printer of the structure outlined above, the maintenance means maintains the ink ejecting head, the operation means operates the maintenance means at a predetermined timing, and the timing changing means changes the timing.

As indicated, the ink ejecting printer of the invention reduces unnecessary head maintenance operations upon selection of the thin-out mode in which printing for draft or for other purposes that may be carried out at lowered levels of quality. This makes it possible to boost printing speed in that mode. When the invention is applied to ink ejecting printers having a water repellent layer over their nozzle surface, the gradual peeling of that layer stemming from head maintenance is minimized because of the reduced frequency of head maintenance so that the service life of the ink ejecting head is prolonged.

These and other objects, features and advantages of the invention will become more apparent upon a reading of the following description in conjunction with review of the appended drawings.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

A first preferred embodiment of the invention will now be described with reference to the drawings.

Figure 2:
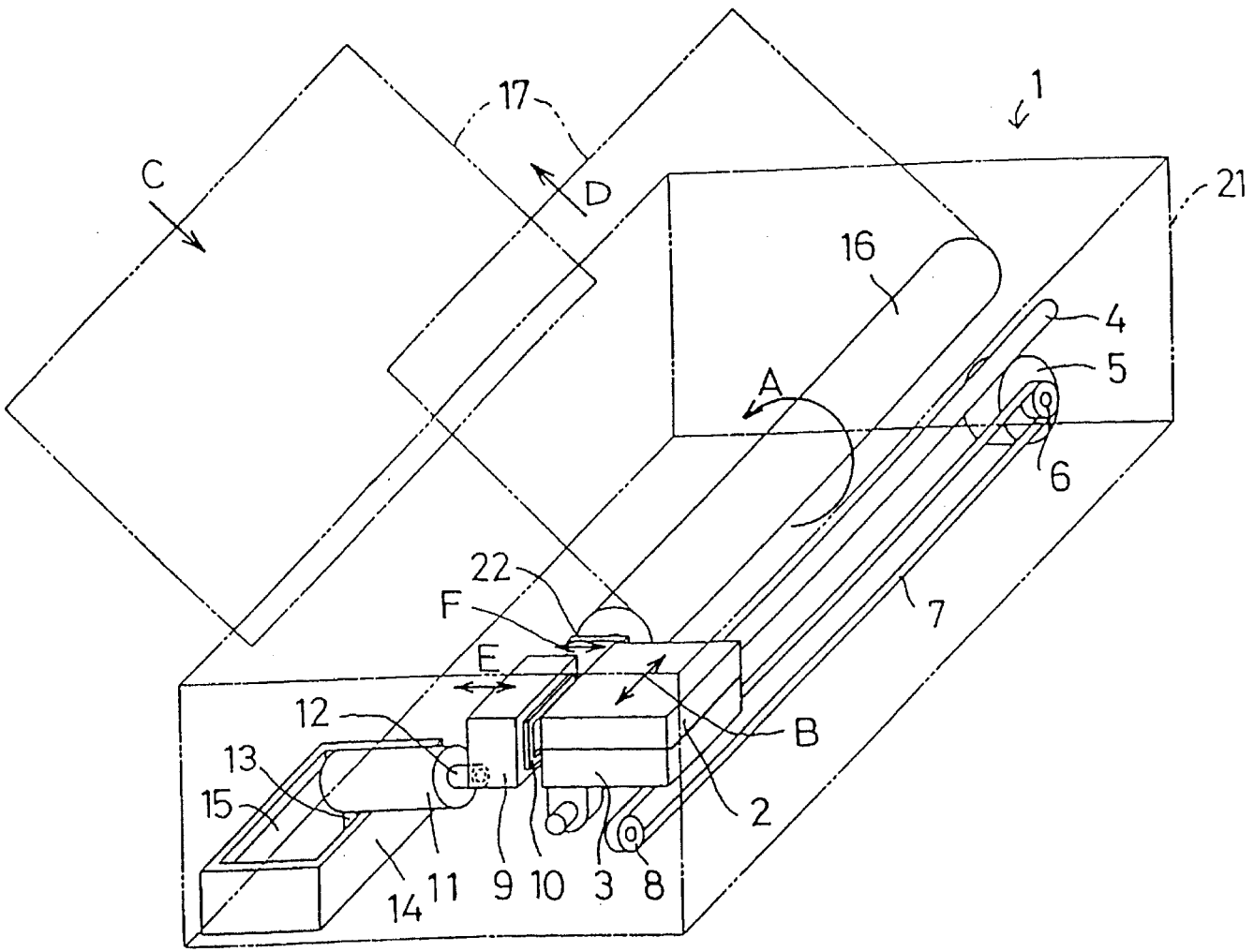
FIG. 2 is a perspective view depicting principal components in the first embodiment.

Referring to FIG. 2, a housing 21 of an ink ejecting printer 1 has a platen 16 that rotates in the direction of arrow A. A guide shaft 4 installed in parallel with the platen 16 has a carriage 3 slidably mounted thereon. A belt 7 is attached to the carriage 3 and is engaged with an idle pulley 8 and a driving pulley 6. The driving pulley 6 is driven by a driving motor 5. The torque of the driving pulley 6 causes the belt 7 to move the carriage 3 along the guide shaft 4 in the directions of arrow B. A head 2 is mounted on the carriage opposite to the platen 16. The head 2 contains ink for printing.

Print paper 17 is inserted into the housing 21 from the rear of the printer 1 in the direction of arrow C. Transported along the platen 16 in the direction of arrow D, the print paper 17 is eventually ejected from the housing 21 of the printer 1. As the print paper 17 is being wound around the platen 16, the head 2 on the carriage 3 is in motion and ejects ink where directed onto the paper to print the desired data.

A cap 9 is located on the left-hand side of the platen 16, as seen in FIG. 2 (near a non-printing position of the head 2). The cap 9 has a rubber cap member 10 for close contact with the head 2. The cap 9 is movably mounted relative to the head 2 so as to move in the directions of arrow E. The rubber cap member 10 can be moved to adhere tightly to the head 2. A connecting tube 12 attached to the cap 9 is linked to a pump 11. The pump 11 has a discharge tube 13 connected therewith. The discharge tube 13 is in turn connected to a waste ink tank 14 that houses an absorbent material 15.

Between the platen 16 and the cap 9 in the non-printing position is a flexible wiper blade 22. The wiper blade 22 is movably mounted so as to move in the directions of arrow F. Normally, the wiper blade 22 is in a retracted, or standby, position and is not in contact with the head 2. For a wiping operation, the wiper blade 22 advances, driven by a motor (not shown), to a position of sliding contact with the head 2.

The nozzle surface of the head 2 is covered with a water repellent layer (not shown). In the first embodiment, the water repellent layer is composed of a uniform film of a fluorine-containing polymer. During manufacture, the film is formed by dipping the nozzle surface into a polymer solution where a fluorine-containing polymer is dissolved in a solvent. The materials used to form the water repellent layer and the method of forming it are described in detail in European Unexamined Publication No. 531,535. The water repellent layer so formed helps to generate the ink meniscus where required and to prevent excess ink from remaining on the nozzle surface. The excess ink, if retained near the nozzles, can cause linearly ejected ink drops to deviate resulting in printing of low quality. Further, the excess ink on the nozzle surface can clog nozzles and, thus, cause missing dots in the print. These problems are solved by providing the water repellent layer over the nozzle surface.

Figure 1:
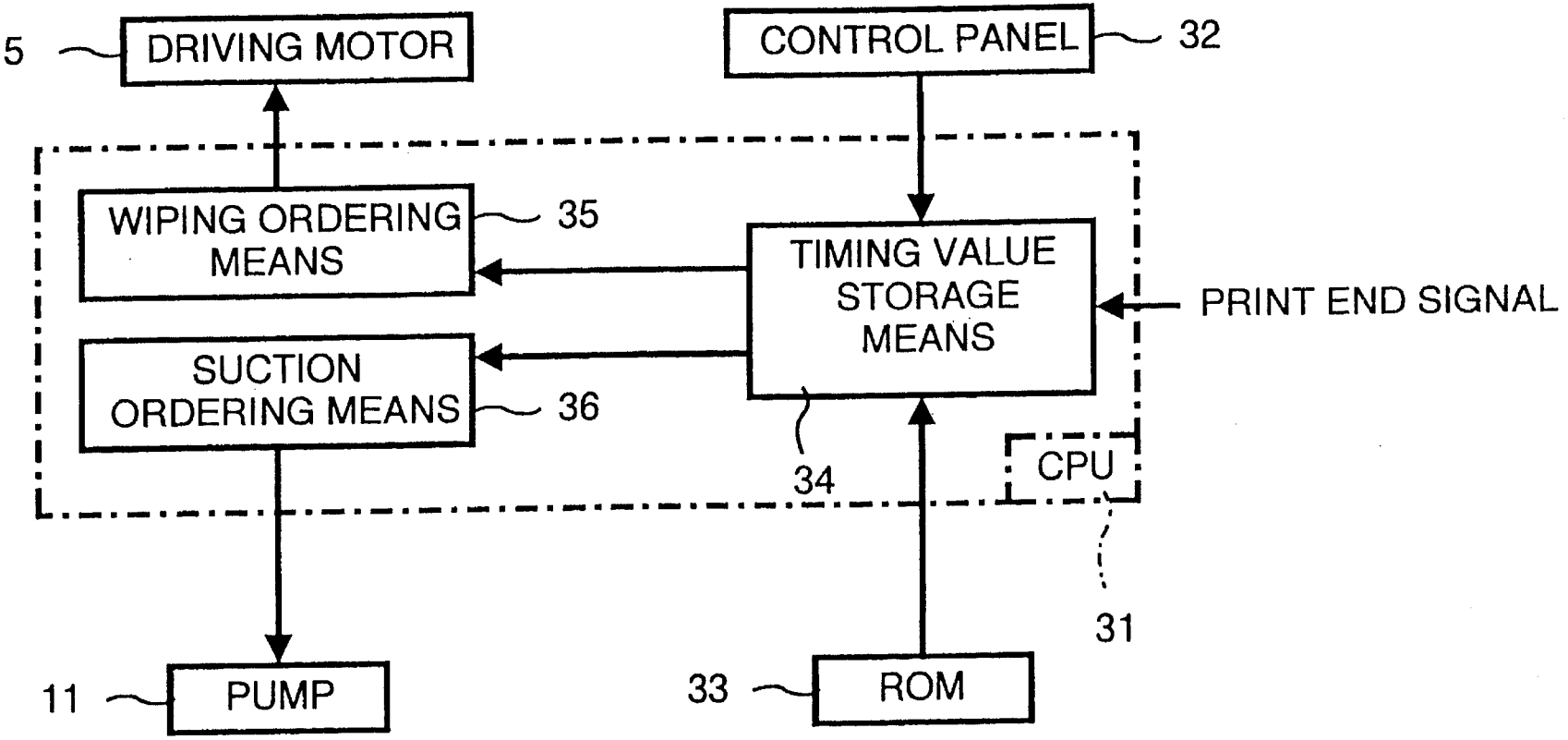
FIG. 1 is a block diagram showing the circuit structure of an ink ejecting printer in the first embodiment.

The circuit structure of the ink ejecting printer in the first embodiment will now be described with reference to the block diagram of FIG. 1. The circuitry of the mechanisms that are not directly relevant to the invention are not described.

A CPU 31, that controls the operation of the ink ejecting printer, is connected to a control panel 32 that allows the user to select a desired printer mode, to the driving motor 5 that drives the carriage 3, to the pump 11 that performs an ink sucking operation, and to a ROM 33 that stores a printer control program and initial values of the timings for the wiping and the sucking operations.

For head maintenance in the first embodiment, a wiping operation is initially set to be carried out for every 30 lines printed, and a sucking operation after each page is printed. The user may replace the initial setting with a half value, a double value or a triple value setting for each timing. Thus, the ROM 33 stores "30 lines" and "one page" as the initial, or default, values of the wiping and suction timings, respectively. The control panel 32 has input means allowing the user to change the wiping and the suction timings to half, double or triple their initial values. The CPU 31 operates under the stored control program to implement functions of various means, to be described below.

Timing value storage means 34 normally stores the initial values of the wiping and the suction timings placed in the ROM 33 or, when the initially set wiping or suction timing is changed using the control panel 32, stores the changed value until a print end signal is input.

When a print operation is started, the wiping ordering means 35 and the suction ordering means 36 read the wiping and suction timing values respectively from the timing value storage area 34. They then check to see if the print operation has reached each of the timing values. When the print operation is found to have reached either of the timings, the corresponding means suspends the printing and orders the driving motor 5 or the pump 11 to carry out the appropriate wiping or sucking operation.

The first embodiment works as follows: the user may wish to change the current maintenance timing for draft printing or for some other purpose. In that case, the user manipulates the control panel 32 to set the wiping and suction timings to, say, twice the initial values. This places "60 lines" and "two pages" into the timing value storage means 34. When a host computer, not shown, supplies print data, the first embodiment starts printing the data. At the same time, the wiping ordering means 35 and suction ordering means 36 start counting line feed signals and page feed signals coming from the host computer, and compare the count values with the values held in the timing value storage means 34.

When the line feed count has reached 60, the wiping ordering means 35 suspends the print operation and causes the wiper blade 22 (FIG. 2) driven by a motor (not shown) to advance to a position of sliding contact with the head 2. The wiping ordering means 35 then sends a control signal to the driving motor 5, thereby moving the carriage 3 from the printing position to the non-printing position. As the carriage moves at the non-printing position, the wiper blade 22 slides over and cleans the nozzle surface. When the page feed count has reached two, the suction ordering means 36 sends a control signal to the driving motor 5 to move the carriage 3 from the printing position to the non-printing position. In the non-printing position, the rubber cap member 10 of the cap 9 (FIG. 2) is brought into close contact with the head 2 and the pump 11 is activated to suck ink from inside the head 2.

When the host computer transmits a print end signal upon completion of the print operation, the timing value storage means 34 replaces the currently set timing values with the initial timing values for wiping and suction stored in the ROM 33, and the operation is terminated.

When the first embodiment of the above structure operates as described, the head is maintained at intervals desired by the user. For draft printing or for other purposes involving reduced levels of printing quality, the user may wish to lower the frequency of head maintenance so as to improve printing speed and to minimize the peeling of the water repellent film from the nozzle surface. As the first embodiment is designed to initialize the maintenance timing in response to each print end signal, although the user may forget to switch the changed timing settings back to normal, the embodiment still reverts automatically to the normal printing quality the next time printing is to be performed. It is also possible in the first embodiment to shorten the maintenance timing. Thus, if the printing quality has deteriorated over time due to, for example, the peeling-off of the water repellent film, head maintenance may be carried out more frequently than normal to improve the printing quality.

In the first embodiment, the maintenance timings are changed stepwise using the control panel. Alternatively, the timings may be changed in a stepless manner either by using the control panel or by using rheostats furnished independently of the control panel. Instead of the wiping and suction timings being changed separately as described, they may be modified collectively.

The first embodiment performs the wiping operation at intervals of the desired number of lines to be printed and the sucking operation at intervals of the desired number of pages to be printed. Alternatively, the wiping and/or sucking operation may be carried out at intervals of other parameters, such as the elapsed time of printing, the number of dots to be printed, or the number of characters to be printed. The invention may also be applied to ink ejecting printers that perform a forced ink spouting operation instead of the sucking operation for cleaning purposes. Instead of allowing both the wiping and the sucking timing to be modified as desired, a variation of the first embodiment may permit only one of the two timings to be changed.

Figure 3:
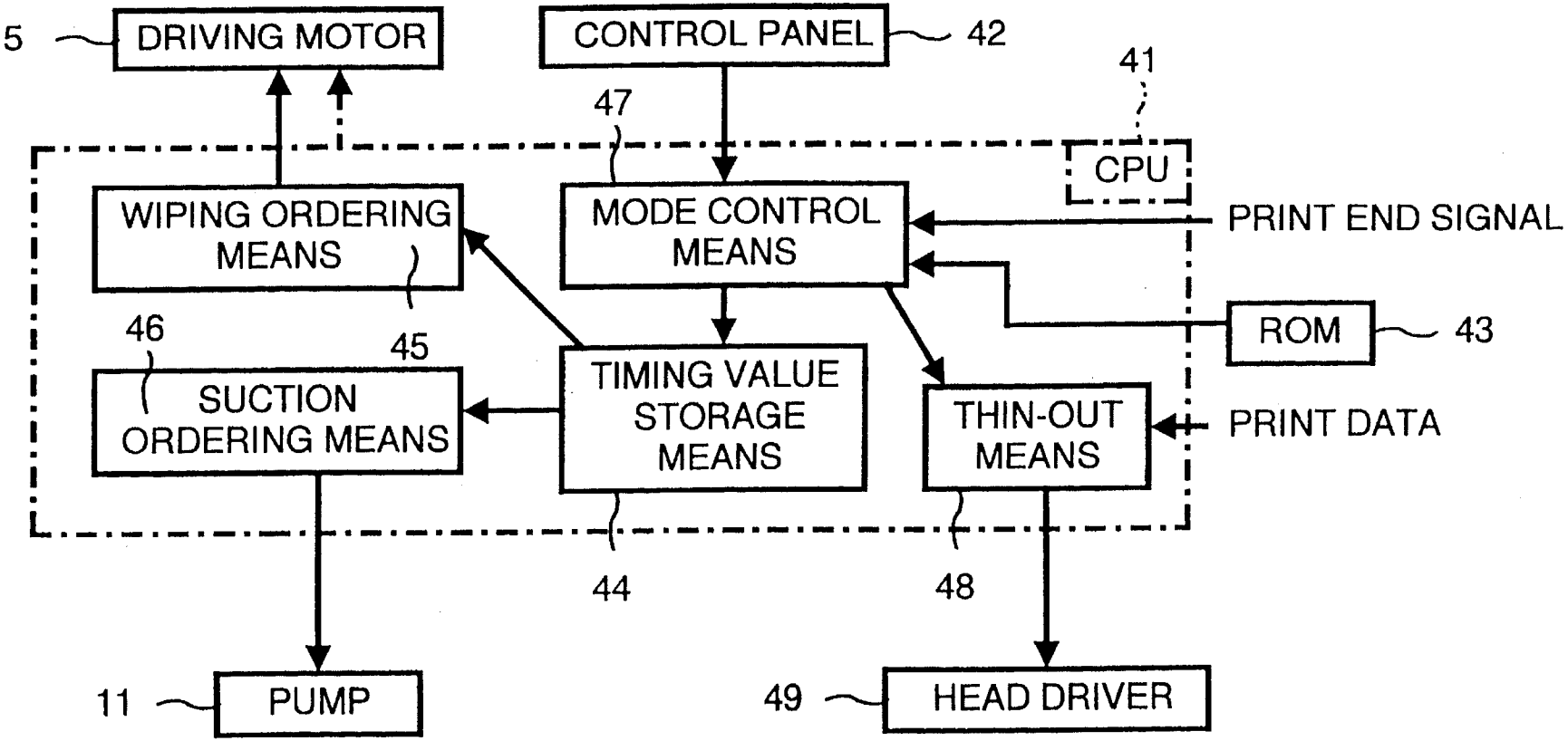
FIG. 3 is a block diagram showing the circuit structure of an ink ejecting printer in the second embodiment.

A second embodiment of the invention will be described with reference to FIG. 3. The parts that are functionally identical to those already described in connection with the first embodiment are designated by the same reference characters, with any repetitive description thereof omitted.

The ink ejecting printer in the second embodiment also has two modes of printing: normal print mode in which the desired image patterns are printed unmodified and a thin-out mode in which the image patterns are thinned out before being printed. The user selects one of the two modes as required. Illustratively, the user will select the thin-out mode if printing of high quality is not desired, such as for draft printing or for other reasons. The thin-out mode so selected provides reduced ink consumption and an increased printing speed. The mechanical structure of the second embodiment is the same as that shown in FIG. 2.

The circuit structure of the second embodiment is described below with reference to the block diagram of FIG. 3. As in the first embodiment, the circuitry of the mechanisms that are not directly relevant to the invention will not be described.

A CPU 41 for controlling the operation of the ink ejecting printer in the second embodiment is connected to a control panel 42 that allows the user to select a desired printer mode, to the driving motor 5 that drives the carriage 3, to the pump 11 that performs the sucking operation, to a ROM 43 that stores a printer control program and the initial values of the timings for the wiping and the sucking operations, and to a head driver 49 that drives the head 2. For head maintenance in the second embodiment, a wiping operation is initially set to be carried out every 20,000 dots printed from any one nozzle, and a sucking operation, every 40,000 dots. Thus the ROM 43 stores "20,000 dots" and "40,000 dots" as the initial values of the wiping and the suction timings, respectively. The control panel 42 has input means allowing the user to set the thin-out mode. The CPU 41 operates under the stored control program to implement functions of various means, to be described below.

Mode control means 47 is provided to order the thin-out means 48 (to be described later), unless otherwise specified, to select the normal print mode in which the desired image patterns are printed unmodified. If the thin-out mode is designated from the control panel 42, the mode control means 47 orders the thin-out means 48 to select and maintain the thin-out mode until a print end signal is input. The mode control means 47 is arranged to supply the timing value storage means 44 with the initial values of the wiping and the suction timings stored in the ROM 43 when the normal print mode is selected, and with values "40,000" and "80,000," i.e., double the initial values of the wiping and the suction timings, when the thin-out mode is selected.

When ordered to select the normal print mode from the mode control means 47, the thin-out means 48 takes print data from the host computer and develops the data into image patterns for outputting the developed patterns to the head driver 49. When ordered to select the thin-out mode, the thin-out means 48 thins out the developed image patterns by removing every other column therefrom before outputting the developed patterns to the head driver 49. At the same time, the thin-out means 48 sends a control signal to the driving motor 5 so as to double the speed of carriage movement.

The timing value storage means 44 is arranged to accommodate the settings of the wiping and the suction timings output from the mode control means 47. When a print operation is started, the wiping ordering means 45 and the suction ordering means 46 retrieve the values of the wiping and the suction timings from the timing value storage means 44 and check to see if the print operation has reached either of the timing values. When the print operation is found to have reached either one of the timings, the corresponding means suspends the printing and causes a wiping or a sucking operation to be carried out.

The second embodiment works as follows: when the user selects the thin-out mode for draft printing or for any other reason by manipulating the control panel 42, the mode control means 47 orders the thin-out means 48 to effect the thin-out mode, and supplies the timing value storage means 44 with the doubled values of the wiping and the suction timings held in the ROM 43. The timing value storage means 44 now accommodates "40,000" and "80,000" as the values of the wiping and the suction timings. When the host computer (not shown) inputs print data, the thin-out means 48 develops the data into image patterns and thins out the developed patterns by removing every other column therefrom. While outputting the thinned-out data to the head driver 49, the thin-out means 48 sends a control signal to the driving motor 5 to double the speed of carriage movement.

This effects a thinned-out print operation involving half the normal ink consumption and twice the normal printing speed. During printing, the CPU 41 counts the number of dots printed per nozzle and outputs the maximum count to the wiping ordering means 45 and suction ordering means 46. In turn, the wiping ordering means 45 and suction ordering means 46 compare the dot count received from the CPU 41 with the values held in the timing value storage means 44.

When the dot count reaches 40,000, and then 80,000, the wiping ordering means 45, and then the suction ordering means 46, cause a wiping and a sucking operation to be performed, respectively, as in the first embodiment.

After further printing, a print end signal from the host computer causes the mode control means 47 to order the thin-out means 48 to revert to the normal print mode. The print end signal also causes the mode control means 47 to supply the timing value storage means 44 again with the initial values of the wiping and the suction timings held in the ROM 43. The print operation is then terminated.

With the second embodiment structured and operating as described above, the user may select the thin-out mode for trial printing or for other purposes not requiring high levels of printing quality. In such a case, the frequency of head maintenance is lowered automatically so that the printing speed can be increased and the peeling of the water repellent film over the head can be prevented. Furthermore, because the second embodiment is designed to initialize the maintenance timings in response to each print end signal, although the user may forget to switch the thin-out mode timing settings back to the normal mode upon completion of thinned-out printing, and the embodiment still reverts automatically from the thin-out mode to the normal print mode having the normal head maintenance timings.

The second embodiment performs the head maintenance operation at intervals of the predetermined number of dots to be printed. Alternatively, the maintenance operation may be carried out at intervals of other parameters such as the elapsed time of printing, the number of lines to be printed, the number of pages to be printed, and the number of characters to be printed. If the head maintenance operation is carried out at intervals of, say, the predetermined number of pages, the dot count per page in the thin-out mode is half of that in the normal print mode. It follows that lowering the head maintenance frequency to half that of the normal print mode still will not affect the printing quality of the thin-out mode. If it is desired in the embodiment above to implement the initial concept of reducing by half the maintenance frequency for the thin-out mode where the head maintenance operation is performed at intervals of the predetermined number of pages to be printed, the result is the maintenance is performed one-fourth as often as that of the normal mode (½ (thin-out)×½ (reduced frequency)=¼ (resultant maintenance)). This also applies to cases where the head maintenance operation is carried out at intervals of a predetermined elapsed time, the number of lines to be printed, and the number of characters to be printed.

An alternative to the above embodiments is to dispense with all head maintenance operations if the thin-out mode is selected. The invention may also be applied to ink ejecting printers that perform a forced ink spouting operation instead of the sucking operation for cleaning purposes. Instead of allowing both the wiping and the sucking timings to be modified as desired, a further variation of the second embodiment may permit only one of the two timings to be changed.

While preferred embodiments of the invention have been described using specific terms, such description is for illustrative purposes only, and it is to be understood that changes and variations may be made without departing from the spirit and scope of the following claims.

What is claimed is:

1. An ink ejecting printer, comprising:

selecting means for selecting one of at least two modes, one of the at least two modes being a normal print mode in which desired image patterns are printed unmodified and another of the at least two modes being a thin-out mode in which the image patterns are thinned out before being printed;

maintenance means for maintaining an ink ejecting head;

operation means for operating said maintenance means at a predetermined operation timing; and timing changing means, when the normal print mode is selected, for setting the operation timing to a first value and, when the thin-out mode is selected, for setting the operation timing to a second value which is greater than the first value.

2. The ink ejecting printer according to claim 1, wherein said maintenance means comprises wiping means for sliding over a nozzle surface of the ink ejecting head so as to clean the nozzle surface.

3. The ink ejecting printer according to claim 1, wherein said maintenance means comprises suction means for sucking ink from the ink ejecting head by way of a nozzle surface thereof.

4. The ink ejecting printer according to claim 1, wherein said maintenance means comprises forced discharging means for forcibly discharging ink from the ink ejecting head.

5. The ink ejecting printer according to claim 1, further comprising:

storage means for storing an initial value of the operation timing; and control means, after the thin-out mode is selected, for switching from the thin-out mode to the normal print mode upon completion of printing in the thin-out mode, and for setting the operation timing back to the initial value stored in said storage means.

6. An ink ejecting printer, comprising:

an ink ejecting head;

selecting means for selecting one of at least two print modes including a draft print mode and a normal print mode;

maintenance means for maintaining the ink ejecting head;

operation means for operating said maintenance means at a predetermined operation timing;

timing changing means for setting the operation timing to a second value for the draft print mode that is a function of a first value predetermined for the normal print mode;

storage means for storing the first value of the operation timing; and control means, after the draft print mode is selected, for switching from the draft mode to the normal print mode upon completion of printing in the draft print mode, and for setting the operation timing back to the first value stored in the storage means.

7. The ink ejecting printer as claimed in claim 6, wherein said timing changing means can be set by an operator independent of said selecting means.

8. The ink ejecting printer as claimed in claim 6, wherein said timing changing means sets the operation timing based on a selection of print mode using said selecting means.

9. The ink ejecting printer as claimed in claim 8, wherein the second value is a predetermined function of the first value.

10. The ink ejecting printer as claimed in claim 6, wherein said maintenance means comprises wiping means for sliding over a nozzle surface of the ink ejecting head so as to clean the nozzle surface.

11. The ink ejecting printer as claimed in claim 10, wherein said maintenance means further comprises suction means for sucking ink from the ink ejecting head by way of a nozzle surface thereof.

12. The ink ejecting printer as claimed in claim 11, wherein each of said first value and said second value comprise an S-value applied to said suction means and a W-value applied to said wiping means.

13. The ink ejecting printer as claimed in claim 12, wherein the S-value and the W-value for the second value may be a different function of a respective S-value and W-value of the first value.

14. The ink ejecting printer as claimed in claim 13, wherein the S-value and the W-value for the first value are set to different predetermined values.

15. The ink ejecting printer as claimed in claim 12, wherein each of the S-value and the W-value may be selected from a measurable item group consisting of number of dots, number of lines, number of pages, and operating time.

16. The ink ejecting printer as claimed in claim 10, wherein said maintenance means further comprises forced discharging means for forcibly discharging ink from the ink ejecting head.

17. The ink ejecting printer as claimed in claim 16, wherein each of said first value and said second value comprise an F-value applied to said forced discharging means and a W-value applied to said wiping means.

18. The ink ejecting printer as claimed in claim 17, wherein the F-value and the W-value for the second value may be different functions of respective F-value and W-value of the first value.

19. The ink ejecting printer as claimed in claim 18, wherein the F-value and the W-value for the first value are set to different predetermined values.

20. The ink ejecting printer as claimed in claim 17, wherein each of the F-value and the W-value may be selected from a measurable item group consisting of number of dots, number of lines, number of pages, and operating time.

* * * * *